US006978993B2

(12) United States Patent
Hurd

(10) Patent No.: US 6,978,993 B2
(45) Date of Patent: Dec. 27, 2005

(54) METHOD AND DEVICE FOR ROTATING A FRICTIONAL SURFACE IN A FRICTION FEEDER

(75) Inventor: Bruce E Hurd, Monroe, CT (US)

(73) Assignee: Pitney Bowes Inc., Stamford, CT (US)

( * ) Notice: Subject to any disclaimer, the term of this patent is extended or adjusted under 35 U.S.C. 154(b) by 243 days.

(21) Appl. No.: 10/686,994

(22) Filed: Oct. 16, 2003

(65) Prior Publication Data

US 2005/0082744 A1 Apr. 21, 2005

(51) Int. Cl.[7] ..... B65H 3/06
(52) U.S. Cl. ..... 271/35; 271/121; 271/124; 271/137
(58) Field of Search ..... 271/35, 121, 124, 271/137

(56) References Cited

U.S. PATENT DOCUMENTS 4,991,831 A * 2/1991 Green ..... 271/121
5,163,669 A * 11/1992 Hurd et al. ..... 271/125
6,485,012 B1 * 11/2002 Bakoledis ..... 271/35
6,758,468 B2 * 7/2004 DaCunha et al. ..... 271/35

* cited by examiner

*Primary Examiner*—Donald P. Walsh
*Assistant Examiner*—Kaitlin Joerger
(74) *Attorney, Agent, or Firm*—Michael J. Cummings; Charles R. Malandra, Jr.; Angelo N. Chaclas

(57) ABSTRACT

A method and device for facilitating the replacement of a worn out section of a friction roller in a friction feeder with another section. The roller is fixedly mounted on a shaft adjacent to the feeder nip. In operation, the shaft is restricted from turning by a locking mechanism. The locking mechanism comprises a locking member and a blocking surface. The shaft has an extended shaft section for slideably mounting the locking member, which has a polygonal outer circumference. When the locking member is located adjacent to the blocking surface, it is restricted from rotating. But when the locking member is slid away from the blocking surface, it can be rotated to cause the shaft to rotate, thereby moving another section of the frictional surface on the friction roller to replace the worn out section near the nip.

16 Claims, 7 Drawing Sheets

METHOD AND DEVICE FOR ROTATING A FRICTIONAL SURFACE IN A FRICTION FEEDER

FIELD OF THE INVENTION

The invention disclosed herein relates generally to a feeder for feeding mail related items such as mail insert materials, envelopes or mailpieces and, more specifically, to a retarding element in a friction feeder for preventing multiple feeds.

BACKGROUND OF THE INVENTION

Friction feeders are known in the art. As the name suggests, a friction feeder relies on the interaction of several components around the exit nip of the feeder that results in the singulation of paper documents in a paper stack. The common components in most friction feeders are the driving mechanism to drive a sheet of paper document out of the exit nip and the retarding element to retain all the other sheets in the stack so as to prevent multiple feeds. To provide the necessary friction for retaining the other sheets in the stack, the surface of the retarding element is usually made of an elastomeric material or a hard, rough coating. Ifkovits, Jr. et al. (U.S. Pat. No. 5,294,102, hereafter referred to as Ifkovits) discloses a friction feeder wherein the surface of the retarding element is coated with tungsten carbide grit. Godlewski (U.S. Pat. No. 4,666,140) discloses a friction feeder wherein the surface of the retarding element is made of an elastomeric-like material. Green (U.S. Pat. No. 5,244,198) discloses a friction feeder wherein the retarding element is a continuous belt made of an elastomeric material mounted on a pair of rollers. A friction feeder can be designed to operate as a top feeder or a bottom feeder. The above-mentioned friction feeders are bottom feeders, wherein the sheets in a generally vertical stack are moved out the stack, one at a time, by a driving mechanism below the stack. A typical friction feeder is shown in FIG. 1. As shown, the feeder 1 uses a driving mechanism 30 to drive the bottom sheet 10 of a stack 20 out of the exit nip 64 and a retarding element 40 (a cylindrical member) to hold back the other bottom sheets. In general, the retarding element 40 has a relatively large diameter at the exit nip so that a number of sheets at the bottom of the stack can fan out to follow the surface curvature of the retarding element, forming a singulated stack portion 24. In the singulated portion, the sheets are slightly separated from each other in that the leading edge of one sheet is positioned slightly ahead of the sheets above. As shown in FIG. 1, the driving mechanism 30 comprises a continuous belt 32 mounted on a pair of rollers 34. However, the driving mechanism can simply be rollers with a resilient surface.

In order for the retarding element 40 to be effective in preventing other bottom sheets from being pulled out by the driving mechanism 30 along with the bottom sheet 10, the retarding element 40 must have a high friction surface 50 which is fixedly mounted on a roller 42. In operation, the high friction surface 50 is stationary relative to the moving sheet 10. The friction between the bottom sheet 10 and the sheet 10' above is lower than the friction between the retarding surface 50 and a sheet 10'. If the surface 50 of the retarding element 40 is coated with a layer of hard grit, as disclosed in Ifkovits, paper dust will accumulate at the surface section 52 at the feed zone 62 where the sheets in the singulated portion 24 are retained by the retarding element 40 when the bottom sheet 10 is driven out of the exit nip 64.

After extensive use, the surface roughness is reduced mainly because of the accumulated paper dust, thereby reducing the effectiveness of the retarding surface 50. If the surface 50 of the retarding element 40 is made of an elastomeric material, as disclosed in Green and Godlewski, the contact between the sheets and the retarding surface 50 at the feed zone 62 will wear out the contact surface section 52, changing the retard characteristics of the elastomeric surface.

In order to provide an unworn portion of the retarding surface to the exit nip, Green uses a locking mechanism to keep the retarding surface stationary in operation. When it is necessary to rotate the retarding surface to provide an unworn portion at the exit nip, the operator loosens the locking mechanism and manually repositions the retarding surface. This manual method of furnishing an unworn portion of the retarding surface is inconsistent and inconvenient.

Thus, it is advantageous and desirable to provide a method and device for rotating the retarding surface in a simple and consistent fashion.

SUMMARY OF THE INVENTION

The present invention provides a method and device for facilitating the replacement of a worn out frictional surface by a fresh one in a friction feeder. This objective can be achieved by mounting a frictional surface on a roller, which is prevented from rotating about a shaft by a polygonal locking member. The locking member is slideably mounted on the same shaft. When the locking member is located at a locked position, it is prevented from being rotated by a blocking surface. But when the locking member is located at an unlocked position, it is allowed to rotate, causing the frictional surface to turn.

Thus, according to the first aspect of the present invention, there is provided a device for use in conjunction with a frictional mechanism in a feeder for releasing substantially flat items from a stack, wherein the feeder has a driving mechanism for driving the flat items at a lower section of the stack through a nip, and the frictional mechanism is disposed near the nip so as to allow one flat item to pass through the nip at a time, wherein the frictional mechanism comprises at least a roller having a frictional surface disposed on a circumference of the roller, and a circumferential section of the frictional surface is in contact with the flat items at the lower section of the stack, said device is used to facilitate replacement of said circumferential section of the frictional surface with another circumferential section of the frictional surface. The device comprises:

a locking member having a plurality of facets forming a polygonal outer circumference of the locking member, each facet coving an angular section;

a shaft, disposed in relation to the nip, for securely mounting the roller, the shaft having a longitudinal axis substantially parallel to the nip, wherein the shaft has a longitudinal section for slideably mounting the locking member, allowing the locking member to move from a first portion of the longitudinal section to a second portion of the longitudinal section when needed, while preventing the locking member from rotating relative to the shaft; and a blocking mechanism, disposed relative to the first portion of the longitudinal section of the shaft, such that when the locking member is positioned at the first portion of the longitudinal section of the shaft, one of the facets is at least partially in contact with the blocking mechanism, preventing the locking member from rotating about the longitudinal axis; and when the locking member is positioned at the second portion of the longitudinal section of the shaft, the locking member is rotatable about the longitudinal axis, causing the shaft to turn, thereby achieving said replacement.

The locking member is rotated at least one angular section when the locking member is positioned at the second portion of the longitudinal section of the shaft, so that when the locking member is moved to the first portion of the longitudinal section of the shaft, a different one of the facets is substantially in contact with the blocking mechanism.

Preferably, the locking member has a non-circular cross section, and the longitudinal section of shaft has a substantially matching cross section for slideably mounting the locking member. Preferably, the non-circular cross section is polygonal in shape.

Preferably, the blocking mechanism comprises a surface which is in close proximity to said one of the facets when the locking member is positioned at the first portion of the longitudinal section of the shaft, and the surface is spaced from the locking member when the locking member when the locking member is positioned at the second portion of the longitudinal section of the shaft.

Advantageously, the feeder comprises a shaft mount for mounting the shaft for rotation about the longitudinal axis of the shaft, and wherein the blocking mechanism is fixedly mounted on the shaft mount.

Preferably, each of the flat items has two side edges substantially perpendicular to the nip, and said at least one roller comprises two rollers, each having a frictional surface disposed near a different one of the two side edges.

Preferably, the shaft has two ends for separately and fixedly mounting the rollers, and wherein the longitudinal section of the shaft is co-axially connecting the two ends.

According to the second aspect of the present invention, there is provided a method for replacing a first circumferential section of a frictional surface with a second circumferential section of the frictional surface in a feeder for releasing substantially flat items from a stack, wherein the feeder comprises:

a driving mechanism for driving the flat items at a lower section of the stack through a nip, and a frictional mechanism disposed near the nip so as to allow one flat item to pass through nip at a time, the frictional mechanism having at least a roller for circumferentially mounting the frictional surface, the roller fixedly mounted on a shaft having a longitudinal axis substantially parallel to the nip, wherein the first circumferential section is in contact with the flat items at the lower section of the stack. The method comprises the steps of:

1) providing a locking mechanism comprising:

a locking member having a plurality of facets forming a polygonal outer circumference of the locking member, each facet covering an angular section;

a longitudinal section on the shaft for slideably mounting the locking member, allowing the locking member to locate at a first portion or at a second portion of the longitudinal section while preventing the locking member and shaft from rotating about the longitudinal axis of the shaft relative to the longitudinal section, wherein the locking member is located at the first portion at least when the feeder is in operation;

a blocking mechanism disposed adjacent to the first portion of the longitudinal section of the shaft such that when the locking member is located at the first portion of the longitudinal section, the blocking member prevents the locking member and shaft from rotating about the longitudinal axis of the shaft, and when the locking member is located at the second position, the locking member and shaft are rotatable about the longitudinal axis of the shaft;

2) sliding the locking member from the first position to the second position;

3) rotating the locking member for causing the shaft to turn at least one angular section so as to allow the second circumferential section to contact with the flat items at the lower section of the stack; and 4) sliding the locking member from the second position to the first position.

According to the third aspect of the present invention, there is provided a feeder for releasing substantially flat items from a stack having a lower section. The feeder comprises:

a driving mechanism, disposed relative to the lower section of the stack, for driving the flat items at the lower section of the stack through a nip along a releasing direction; and a frictional mechanism, disposed adjacent to the nip, for allowing one flat item to pass through the nip at a time, said frictional mechanism comprising:

at least one roller, the roller having a frictional surface fixedly mounted on a circumference of the roller, the frictional surface having a circumferential section in contact with the flat items at the lower section of the stack;

a locking member having a plurality of facets forming a polygonal outer circumference of the locking member, each facet covering an angular section;

a shaft having a longitudinal axis substantially parallel to the nip for fixedly mounted the roller, the shaft having a longitudinal section for slideably mounting the locking member, allowing the locking member to be located in a first portion or a second portion of the longitudinal section; and a blocking mechanism, disposed adjacent to the first portion of the longitudinal section of the shaft such that when the locking member is located at the first portion of the longitudinal section of the shaft, the blocking member is at least partially in contact with one of the facets of the locking member, preventing the locking member and shaft from rotating about the longitudinal axis, and when the locking member is located at the second portion of the longitudinal section, the locking member and shaft are rotatable about the longitudinal axis, causing the shaft to turn, thereby replacing said circumferential section of the frictional surface with another circumferential section of the frictional surface.

Advantageously, the feeder can be used in an addressing machine for releasing envelopes. The feeder can also be used in a mailing machine for releasing enclosure documents into an insertion station where the released documents are inserted into envelopes. The feeder can be used to release sheets of paper in any paper handling machines, such as printers, photocopiers and the like.

The present invention will become apparent upon reading the description taken in conjunction with FIGS. 2 to 11.

DESCRIPTION OF THE DRAWINGS

The above and other objects and advantages of the present invention will be apparent upon consideration of the following detailed description, taken in conjunction with accompanying drawings, in which like reference characters refer to like parts throughout, and in which.

DETAILED DESCRIPTION OF THE PRESENT INVENTION

Figure 1:
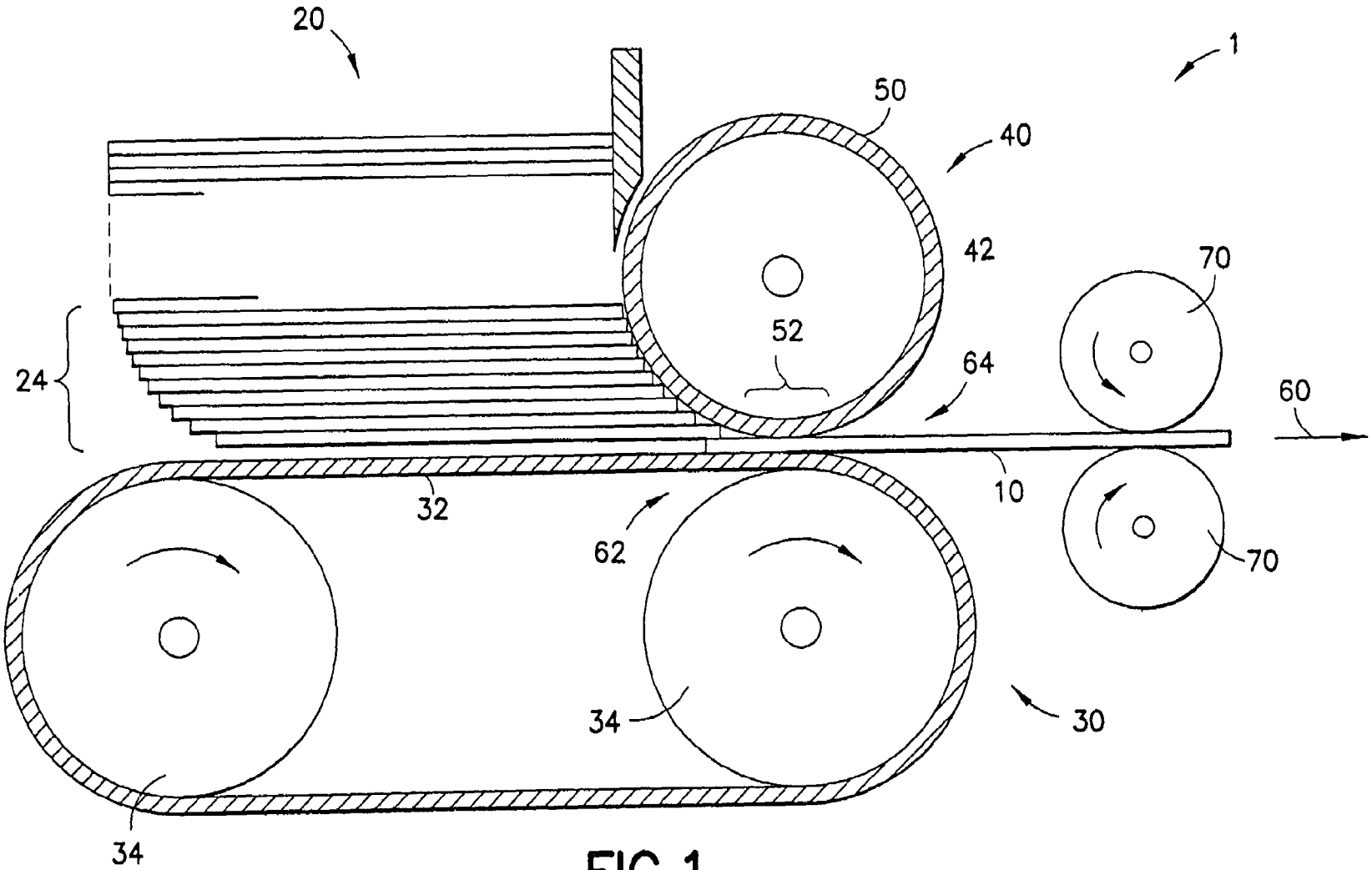
FIG. 1 PRIOR ART
FIG. 1 is; a schematic representation illustrating a typical friction feeder.
Figure 2:
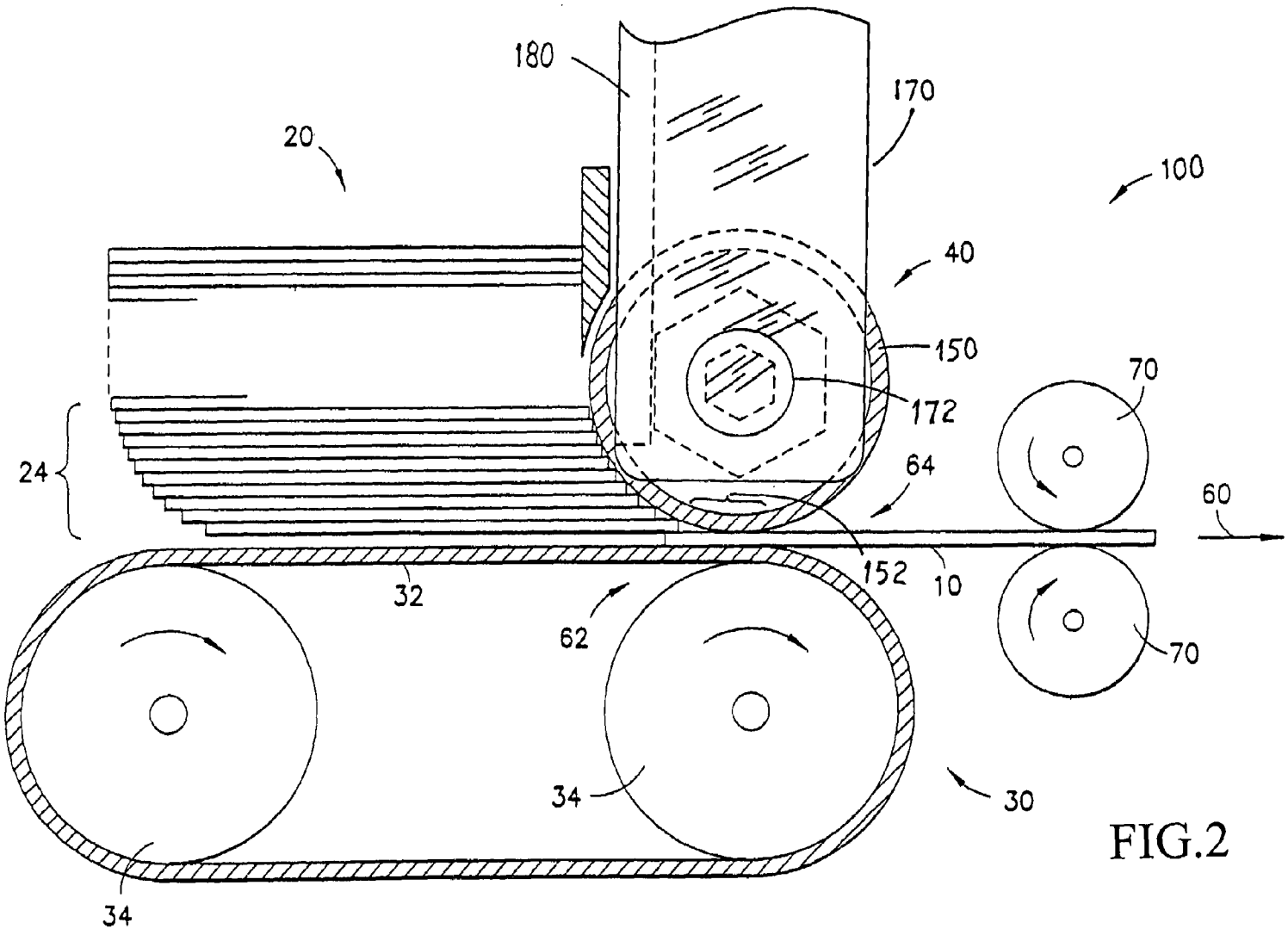
FIG. 2 is; a schematic representation illustrating the side view of a friction feeder with a frictional mechanism, according to the present invention.
Figure 8:
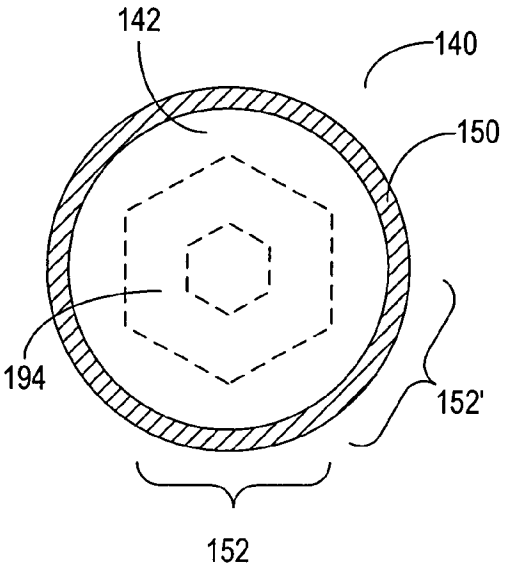
FIG. 8 is; a schematic representation showing the separation roller in relation to the locking member.

In describing the present invention, reference is made to the drawings, wherein there is seen in FIG. 2 is a schematic representation of a friction feeder having the frictional mechanism, according to the present invention. As shown in the figure, the friction feeder 100 uses a driving mechanism 30 to drive the bottom sheet of document 10 of a stack 20 through the exit nip 62 along the releasing direction 60. A pair of pickup rollers 70 is used to move the released sheet 10 further along the releasing direction. The retarding element, or the frictional mechanism 140 comprises a pair of separation rollers 140, each having a cylindrical surface 150 made of a high friction material, such as rubber, urethane or the like securely bonded to the hub of the roller 142 (see FIG. 8). The roller hubs 142 and the frictional surface 150 are stationary in relation to the stack 20 so as to prevent more than one sheet 10 from being released. A section 152 of the frictional surface 150 is in contact of the released sheet 10 and other sheets in the singulated portion 24 near the bottom section of the stack 20. After a long period of operation, the section 152 is eventually worn out, and the frictional surface sometimes allows more than one sheet 10 to pass through the exit nip 64. In order to eliminate the "double feeds", it is necessary to rotate the rollers 140 by a certain angle so as to allow a fresh, or unused, section of the frictional surface to replaced the worn out section.

Figure 5A:
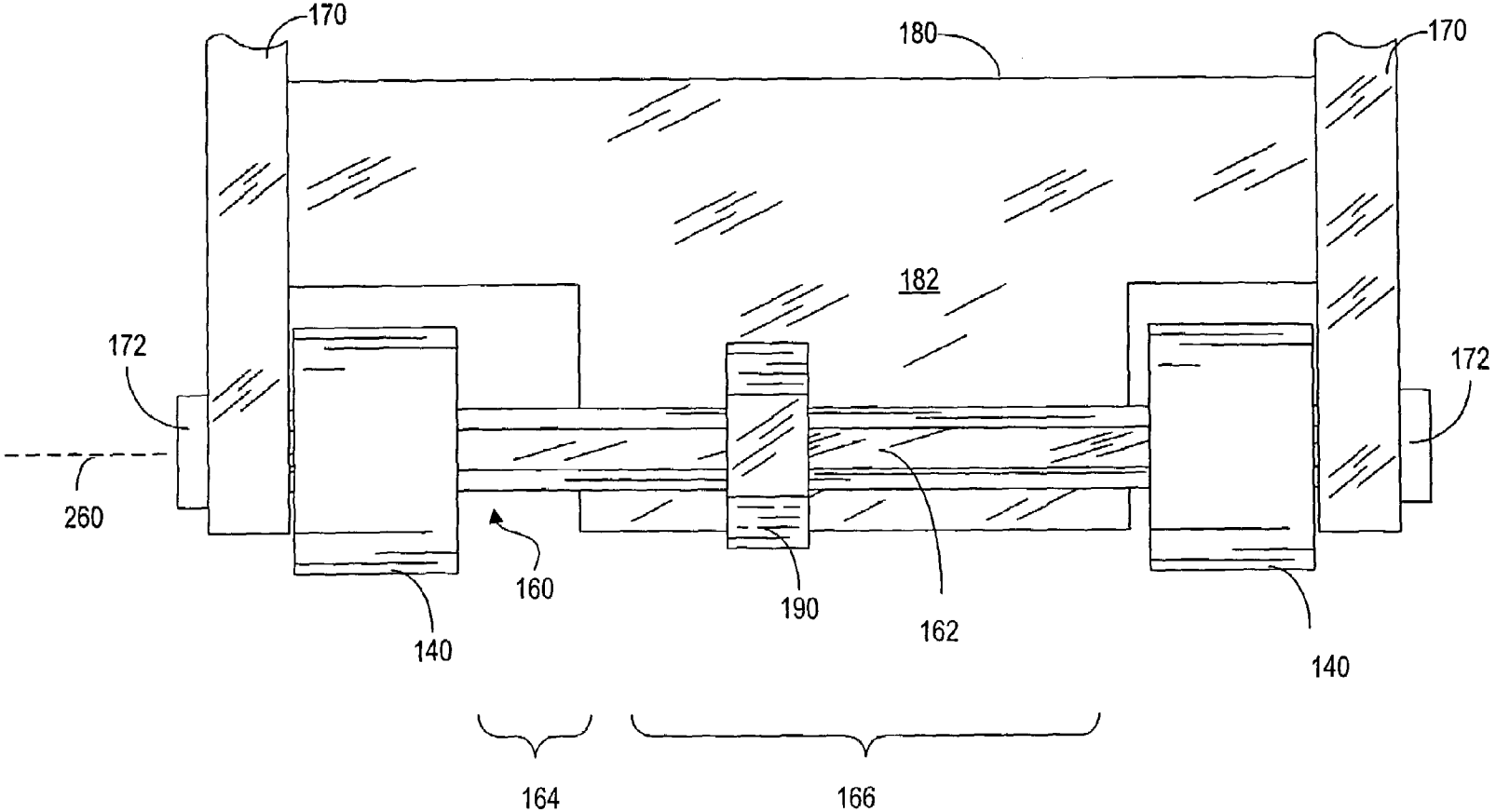
FIG. 5*a* is; a front view showing the frictional mechanism, according to the present invention, wherein the locking member is located at the locked position.
Figure 5B:
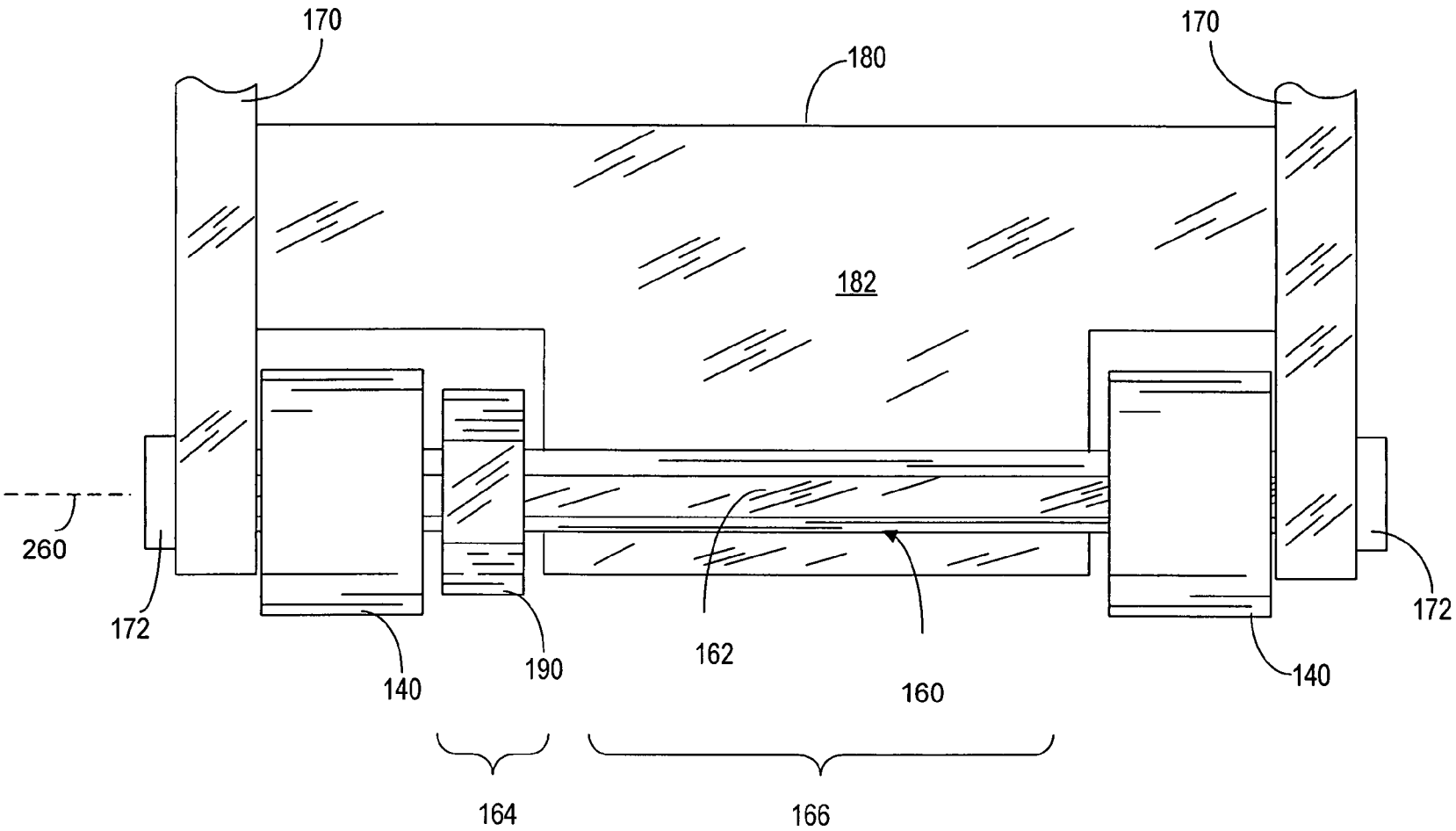
FIG. 5*b* is; a front view showing the frictional mechanism, according to the present invention, wherein the locking member is located at the unlocked position.

The rollers 140 are securely mounted on a shaft 160 (see FIGS. 5*a* and 5*b*). The shaft 160 is mounted on a shaft mount 170 and retained by a pair of shoulder bolts 172. The shaft 160 is normally locked so that the rollers 140 are stationary. But when the shaft 160 is unlocked, the rollers 140 can be manually rotated. The shaft 160 is locked by a locking member 190, as shown in FIG. 5*a*.

The locking member 190 is basically a polygonal ring-like body having a plurality of facets 194. The locking member 190 also has a center opening 192 to fit the cross section of shaft 160. As can be seen in FIGS. 5*a* and 5*b*, the shaft 160 has a longitudinal section 162, wherein the cross section is polygonal. As shown in the FIG. 4, the cross section of the longitudinal section 162 of the shaft 160 is hexagonal. Thus, the center opening 192 of the locking member 190 is also hexagonal. As such, while the locking member 190 can be moved along the longitudinal section 162 from one part of the longitudinal section 162 to another part, the locking member 190 cannot be rotated relative to the shaft 190. Thus, when the locking member 190 is rotated when it is not locked, the shaft 160 and the separation rollers 140 are also caused to rotate accordingly.

Figure 6:
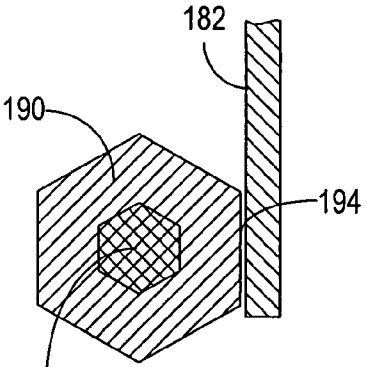
FIG. 6 is; a cross sectional view showing the locking member in relation to the blocking surface when the locking member is located at the locked position.

As shown in FIG. 5*a*, the separation rollers 140 are mounted on two ends of the shaft 160. Between the separation rollers 140, the shaft 160 has a longitudinal section 162 for mounting the locking member 190. In order to lock and unlock the shaft 160, a blocking mechanism 180 having a block surface 182 is disposed relative to the longitudinal section 162 of the shaft 160. The blocking surface 182 is adjacent to a portion 166 of the longitudinal section 162, such that when the locking member 190 is positioned in the portion 166, as shown in FIG. 5*a*, it is prevented by the blocking surface 182 from being rotated. As shown in FIG. 6, when the locking member 190 is positioned in the portion 164, only a small gap exists between one of the facets 194 and the blocking surface 182. Because the blocking surface 182 interferes with the rotational movement of the locking member 190, the locking member 190, the shaft 160 and the separation rollers 140 are stationary relative to the shaft mount 170. As such, the frictional surface 150 is locked.

Figure 7:
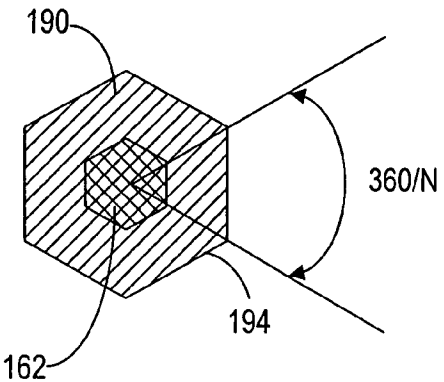
FIG. 7 is; a cross sectional view showing the locking member in relation to the blocking surface when the locking member is located at the unlocked position.

But when the locking member 190 is slid from the portion 166 to the portion 164 of the longitudinal section 162, as shown in FIG. 5*b*, it is moved away from the blocking surface 182. As such, the locking member 190, along with the shaft 160, can be rotated freely about the longitudinal axis of the shaft, as shown in FIG. 7. As such, it allows the operator the replace the worn out section 152 with a fresh surface section 152' (see FIG. 8).

When the friction feeder 100 is in operation, the locking member 190 is located in the portion 166 of the shaft 160 in order to lock the separation rollers 140 in place. But, when it is desirable or necessary to replace the worn out surface section 152 with a fresh surface section 152' (see FIG. 8), the operator moves the locking member 190 from the portion 166 of the shaft 160 to the portion 164. The operator rotates the locking member 190 by 360°/N, with N being the number of facets on the locking member 190. Afterward the operator slides the locking member 190 to the portion 166 of the shaft 160 in order to lock the separator rollers.

Figure 9:
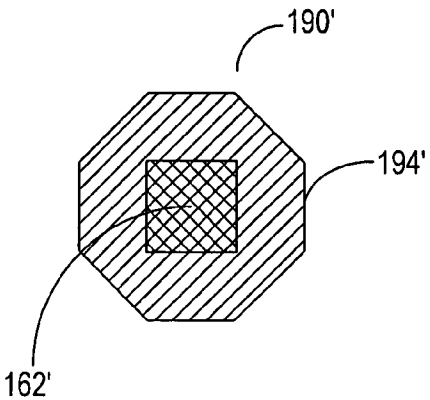
FIG. 9 is; a cross sectional view of the locking member with a different shape.
Figure 4:
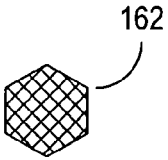
FIG. 4 is; a cross sectional view of the shaft section on which the locking member is slideably mounted.
Figure 3:
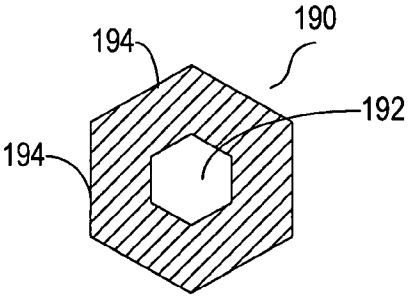
FIG. 3 is; a cross sectional view of a locking member, according to the present invention.

Preferably, the outer perimeter of the locking member 190 is hexagonal, formed by six facets 194. However, the number of facets can be any suitable integer, depending on the size of the locking member and the width of the contact section 152. The number of facets can be as small as three to form a triangle, and as large as twelve or more. Furthermore, the shape of the outer perimeter of the locking member 190 can be the same as the shape of the center opening 192, as shown in FIGS. 3 and 4. However, it is possible that the shape of the outer perimeter is different from the shape of the center opening 192, as shown in FIG. 9. In FIG. 9, the outer perimeter is octagonal, but the center opening 192' is square. In that case, the cross section of the longitudinal section 162' of the shaft is also square. Thus, in general, the shape of the outer perimeter is polygonal, so that the replaced section 152' of the frictional surface 150 is consistently determined by the rotational angle 360°/N, with N being the number of facets of the outer perimeter. Furthermore, the cross section of the shaft section 162 can be regular polygonal, such as that shown in FIGS. 4 and 9, but it can also be a rectangle, a "D" shape, or the like, so long as the locking member 190 can be slid between the portion 164 and the portion 166 when desired and the shaft 160 is caused to rotate along with the locking member 190 when the locking member 190 is rotated about the longitudinal axis 260.

Figure 10:
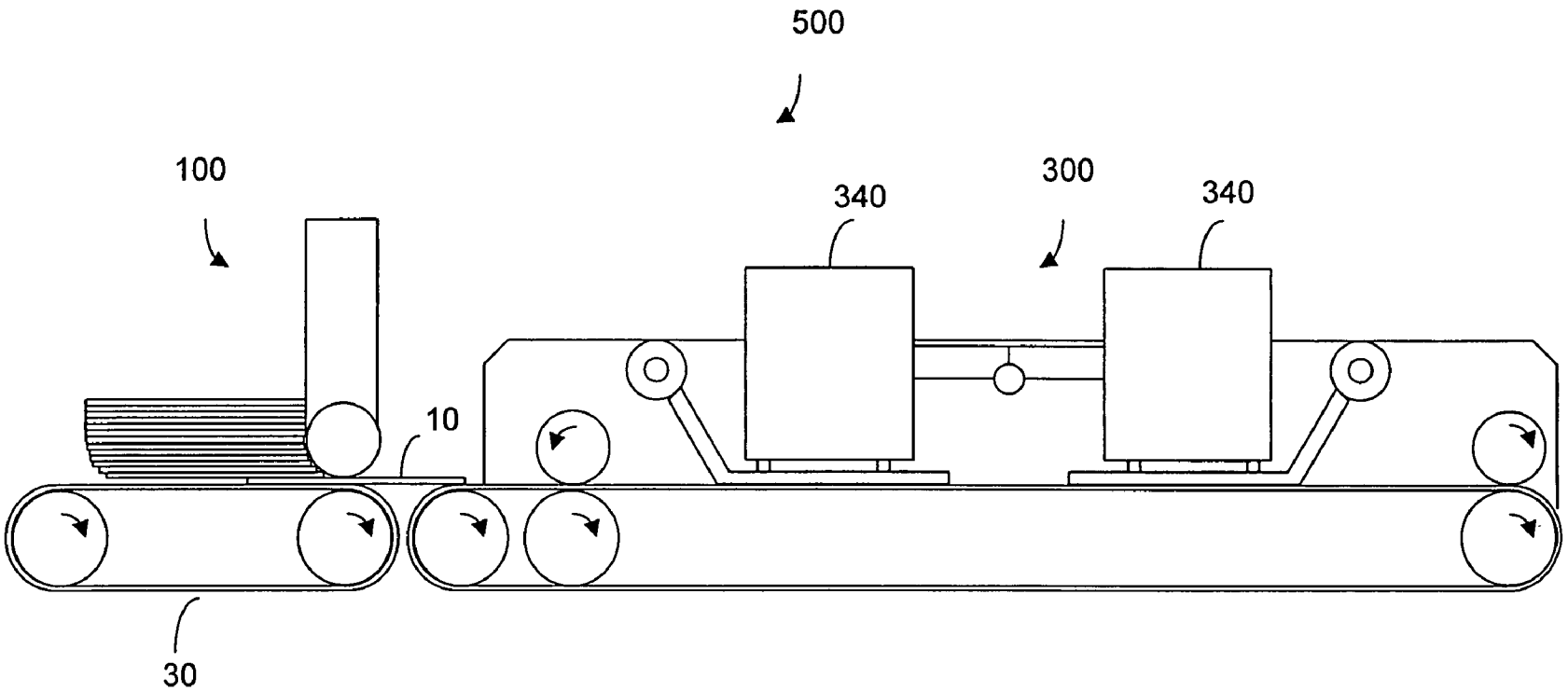
FIG. 10 is; a schematic representation illustrating an addressing machine.
Figure 11:
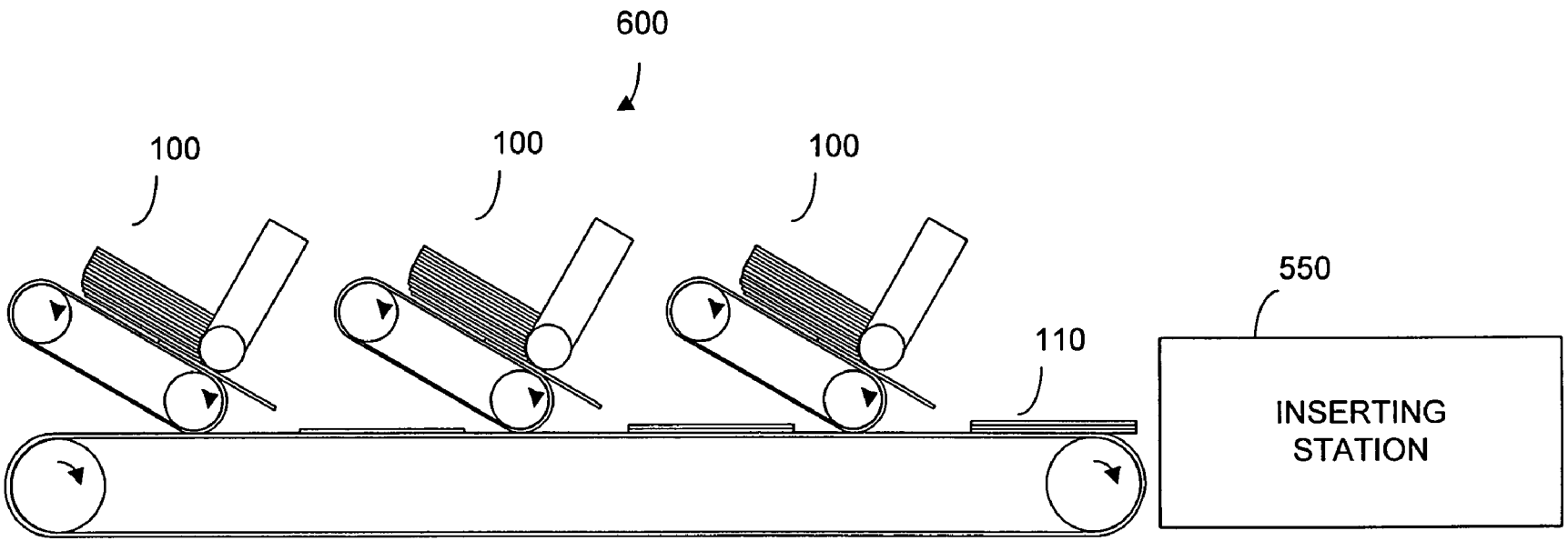
FIG. 11 is; a schematic representation illustrating a mailing machine.

It should be noted that the item 10, as shown in FIG. 2, can be any substantially flat item. For example, it can be an envelope, a mailpiece, a sheet of paper or the like. Thus, the friction feeder 100, according to the present invention, can be used to release envelopes or mailpieces in an addressing machine 500, as shown in FIG. 10. As shown in the figure, the feeder 100 is used to release envelopes, one at a time, to a printing section 300, wherein a plurality of printing assemblies 340 are used to print a mailing address, return address or promotional messages on the envelope 10. One or more feeders 100 can be used in a mailing machine to separately release enclosure documents. The release documents are gathered into a stack 110 and conveyed to an inserting station 550, where the stack of enclosure documents is inserted into an envelope. Furthermore, the feeder 100 can be used in any paper handling machine where paper is fed one sheet at a time for printing, photocopying or the like.

Moreover, the blocking member 182, as depicted in FIG. 6, does not have to be a flat surface. It can be a rod, a curved surface or the like, so long as the blocking member 182 can prevent the locking member 190 from rotating about the shaft when the locking member 190 is located adjacent to the blocking member 182.

While the present invention has been disclosed and described with reference to a single embodiment thereof, it will be apparent, as noted above that variations and modifications may be made therein. It is also noted that the present invention is independent of the machine being controlled, and is not limited to the control of inserting machines. It is, thus, intended in the following claims to cover each variation and modification that falls within the true spirit and scope of the present invention.

What is claimed is:

1. A device for use in conjunction with a frictional mechanism in a feeder for releasing substantially flat items from a stack, wherein the feeder has a driving mechanism for driving the flat items at a lower section of the stack through a nip, and the frictional mechanism is disposed near the nip so as to allow one flat item to pass through the nip at a time, wherein the frictional mechanism comprises at least a roller having a frictional surface disposed on a circumference of the roller, and a circumferential section of the frictional surface is in contact with the flat items at the lower section of the stack, said device is used to facilitate replacement of said circumferential section of the frictional surface with another circumferential section of the frictional surface, said device comprising:

a locking member having a plurality of facets forming a polygonal outer circumference of the locking member, each facet coving an angular section;

a shaft, disposed in relation to the nip, for securely mounting the roller, the shaft having a longitudinal axis substantially parallel to the nip, wherein the shaft has a longitudinal section for slideably mounting the locking member, allowing the locking member to move from a first portion of the longitudinal section to a second portion of the longitudinal section when needed, while preventing the locking member from rotating relative to the shaft; and a blocking mechanism, disposed relative to the first portion of the longitudinal section of the shaft, such that when the locking member is positioned at the first portion of the longitudinal section of the shaft, one of the facets is at least partially in contact with the blocking mechanism, preventing the locking member and shaft from rotating about the longitudinal axis; and when the locking member is positioned at the second portion of the longitudinal section of the shaft, the locking member and shaft are rotatable about the longitudinal axis, causing the shaft to turn, thereby achieving said replacement.

2. The device of claim 1, wherein the locking member is rotated at least one angular section when the locking member is positioned at the second portion of the longitudinal section of the shaft, so that when the locking member is moved to the first portion of the longitudinal section of the shaft, a different one of the facets is substantially in contact with the blocking mechanism.

3. The device of claim 1, wherein the locking member has a non-circular cross section, and the longitudinal section of shaft has a substantially matching cross section for slideably mounting the locking member.

4. The device of claim 3, wherein the non-circular cross section is polygonal in shape.

5. The device of claim 3, wherein the non-circular cross section is hexagonal in shape.

6. The device of claim 1, wherein the blocking mechanism comprises a surface which is in close proximity to said one of the facets when the locking member is positioned at the first portion of the longitudinal section of the shaft, and the surface is spaced from the locking member when the locking member when the locking member is positioned at the second portion of the longitudinal section of the shaft.

7. The device of claim 1, wherein the feeder comprises a shaft mount for mounting the shaft for rotation about the longitudinal axis of the shaft, and wherein the blocking mechanism is fixedly mounted on the shaft mount.

8. The device of claim 1, wherein each of the flat items has two side edges substantially perpendicular to the nip, and said at least one roller comprises two rollers, each having a frictional surface disposed near a different one of the two side edges.

9. The device of claim 8, wherein the shaft has two ends for separately and fixedly mounting the rollers, and wherein the longitudinal section of the shaft is co-axially connecting the two ends.

10. The device of claim 1, wherein the polygonal circumference has six sides, and each angular section is substantially equal to 60 degrees of the outer circumference.

11. A method for replacing a first circumferential section of a frictional surface with a second circumferential section of the frictional surface in a feeder for releasing substantially flat items from a stack, wherein the feeder comprises:

a driving mechanism for driving the flat items at a lower section of the stack through a nip, and a frictional mechanism disposed near the nip so as to allow one flat item to pass through nip at a time, the frictional mechanism having at least a roller for circumferentially mounting the frictional surface, the roller fixedly mounted on a shaft having a longitudinal axis substantially parallel to the nip, wherein the first circumferential section is in contact with the flat items at the lower section of the stack, said method comprising the steps of:

1) providing a locking mechanism comprising:

a locking member having a plurality of facets forming a polygonal outer circumference of the locking member, each facet covering an angular section;

a longitudinal section on the shaft for slideably mounting the locking member, allowing the locking member to locate at a first portion or at a second portion of the longitudinal section while preventing the locking member from rotating about the longitudinal axis of the shaft relative to the longitudinal section, wherein the locking member is located at the first portion at least when the feeder is in operation;

a blocking mechanism disposed adjacent to the first portion of the longitudinal section of the shaft such that when the locking member is located at the first portion of the longitudinal section, the blocking member prevents the locking member and shaft from rotating about the longitudinal axis of the shaft, and when the locking member is located at the second position, the locking member and shaft are rotatable about the longitudinal axis of the shaft;

2) sliding the locking member from the first position to the second position;

3) rotating the locking member for causing the shaft to turn at least one angular section so as to allow the second circumferential section to contact with the flat items at the lower section of the stack; and 4) sliding the locking member from the second position to the first position.

12. The method of claim 11, wherein the blocking mechanism comprises a surface which is in close proximity to said one of the facets when the locking member is positioned at the first portion of the longitudinal section of the shaft, and the surface is spaced from the locking member when the locking member when the locking member is positioned at the second portion of the longitudinal section of the shaft.

13. A feeder for releasing substantially flat items from a stack having a lower section, the feeder comprising:

a driving mechanism, disposed relative to the lower section of the stack, for driving the flat items at the lower section of the stack through a nip along a releasing direction; and a frictional mechanism, disposed adjacent to the nip, for allowing one flat item to pass through the nip at a time, said frictional mechanism comprising:

at least one roller, the roller having a frictional surface fixedly mounted on a circumference of the roller, the frictional surface having a circumferential section in contact with the flat items at the lower section of the stack;

a locking member having a plurality of facets forming a polygonal outer circumference of the locking member, each facet covering an angular section;

a shaft having a longitudinal axis substantially parallel to the nip for fixedly mounted the roller, the shaft having a longitudinal section for slideably mounting the locking member, allowing the locking member to be located in a first portion or a second portion of the longitudinal section; and a blocking mechanism, disposed adjacent to the first portion of the longitudinal section of the shaft such that when the locking member is located at the first portion of the longitudinal section of the shaft, the blocking member is at least partially in contact with one of the facets of the locking member, preventing the locking member and shaft from rotating about the longitudinal axis, and when the locking member is located at the second portion of the longitudinal section, the locking member and shaft are rotatable about the longitudinal axis, causing the shaft to turn, thereby replacing said circumferential section of the frictional surface with another circumferential section of the frictional surface.

14. The feeder of claim 13, wherein the flat items comprising a plurality of envelopes for use in an addressing machine.

15. The feeder of claim 13, wherein the flat items comprises a plurality of enclosure documents for inserting into envelopes in a mailing machine.

16. The feeder of claim 13, wherein the flat items comprises a plurality of sheets of paper.

* * * * *